US006085466A

United States Patent [19]

Martin et al.

[11] Patent Number: 6,085,466

[45] Date of Patent: Jul. 11, 2000

[54] RAIN GUTTER CORNER SEGMENT CONSTRUCTION

[76] Inventors: Walter Martin; Jeanne Martin, both of 1019 Cornell Dr., Warminster, Pa. 18974

[21] Appl. No.: 09/226,563

[22] Filed: Jan. 7, 1999

[51] Int. Cl.[7] ..... E04D 13/064

[52] U.S. Cl. ..... 52/13; 52/11; 52/12

[58] Field of Search ..... 52/11, 12, 13

[56] References Cited

U.S. PATENT DOCUMENTS 3,611,731 10/1971 Edmondson ..... 52/12

5,617,678 4/1997 Morandin et al. ..... 52/11

5,911,659 6/1999 Serano ..... 52/12

*Primary Examiner*—Christopher T. Kent

*Assistant Examiner*—Jennifer I. Thissell

*Attorney, Agent, or Firm*—Henderson & Sturm LLP

[57] ABSTRACT

A corner segment construction 10 for rain gutters including a pair of perpendicularly aligned inner walls 21, 22, a generally curved outer wall 23, a floor 26 connecting said walls 21, 22, and 23 together and a pair of contoured drain inserts 24, 25 disposed at the juncture 30 of the pair of perpendicularly aligned walls 21, 22 to define a generally curved rain gutter channel 27 devoid of any corners or sharp angles that would induce turbulence or promote the collection of debris in the gutter channel 27.

10 Claims, 2 Drawing Sheets

RAIN GUTTER CORNER SEGMENT CONSTRUCTION

BACKGROUND OF THE INVENTION

1. Field of the Invention

The present invention relates to the field of rain gutter constructions in general, and in particular to an internally rounded configuration for a rain gutter corner segment.

2. Description of Related Art

As can be seen by reference to the following U.S. Pat. Nos. 3,913,284; 4,646,487; 4,858,396; 5,497,583; and 5,729,937, the prior art is replete with myriad and diverse rain gutter constructions.

While all of the aforementioned prior art constructions are more than adequate for tie basic purpose and function for which they have been specifically designed, they are uniformly deficient with respect to their failure to provide a simple, efficient, and practical rain gutter construction that prevents the buildup of leaves and debris at the interior and exterior corners of a rain gutter, and which will promote both self flushing of the gutter trough, as well as simplify the assisted cleaning of a length of gutter pipe.

In addition, the sharp edged interior and exterior corner joints of the gutter pipes present their own unique flow description problems in that a great deal of turbulence is generated by the sharp interior edge of the exterior corner joint and the exterior edge of the interior corner joint. A swirling whirlpool eddy is formed on the interior corner of the interior corner joint and the exterior corner of the exterior corner joint, and this whirlpool eddy allows the heavier debris and leaf particles to settle out of the flow stream and allow debris to accumulate in the vicinity of the eddy.

As a consequence of the foregoing situation, there has existed a longstanding need among homeowners for a new type of smooth cornered rain gutter construction that will promote the flow of water through and prevent the accumulation of debris within the interior angled sections of rain gutter pipe, and the provision of such a construction is a stated objective of the present invention.

BRIEF SUMMARY OF THE INVENTION

Briefly stated, the corner segment construction for rain gutters that forms the basis of the present invention comprises in general, an interior corner segment and an exterior corner segment that share a number of common structural features.

As will be explained in greater detail further on in the specification, both the interior and exterior corner segments are provided with a pair of generally perpendicularly aligned interior walls which are connected by a gutter floor panel to a generally continuously curved exterior wall.

In addition, the interior juncture of the perpendicularly aligned walls are provided with a pair of drain insert that cooperate with one another to form a smooth curved wall surface which is aligned with the curved outer wall to form a curved fluid flow passageway through each of the corner segments to provide a generally turbulence free fluid flow through the interior and exterior corner segments.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
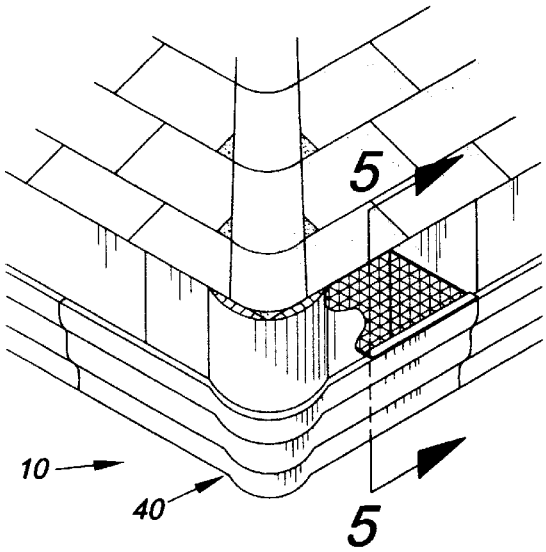
FIG. 1 is a perspective view of the exterior corner segment of the rain gutter construction of the invention installed under the eaves of a roof.
Figure 2:
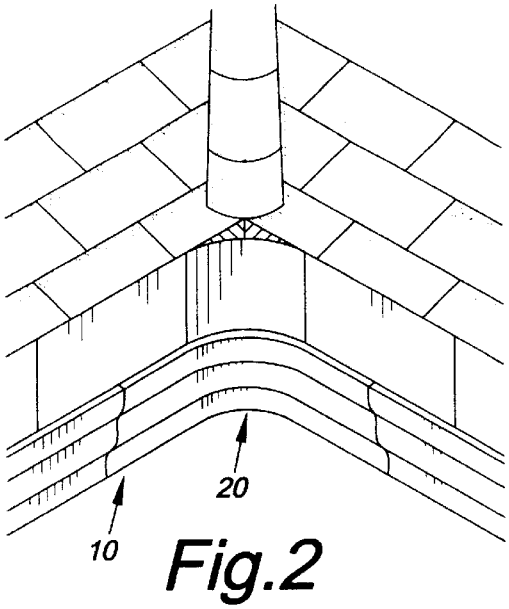
FIG. 2 is a perspective view of the interior corner segment of the rain gutter construction.

As can be seen by reference to the drawings, and in particularly to FIG. 1, the rain gutter corner segment construction that forms the basis of the present invention is designated generally by the reference number 10. The construction 10 comprises in general, an interior corner segment 20 and an exterior corner segment 40 which share common structural features as will be explained presently.

As shown in FIGS. 1 through 4, both of the corner segments 20 and 40 have a pair of generally perpendicularly aligned interior walls 21, 22 and 41, 42 and a generally continuously curved exterior wall 23, 43. The perpendicularly aligned walls 21, 22 and 41, 42 are provided with contoured interior drain inserts 24, 25 and 44, 45 which cooperate with the generally continuously curved exterior wall 23, 43 and a gutter floor panel 26, 46 to define a generally curved interior gutter channel 27, 47 such that the fluid passageway in both the interior 20 and exterior 40 corner segments are devoid of any sharp edges or corners.

Figure 3:
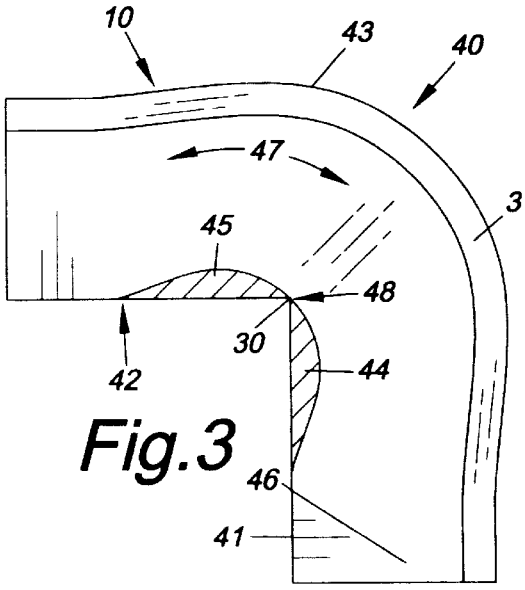
FIG. 3 is a top plan view of the exterior corner segment.
Figure 4:
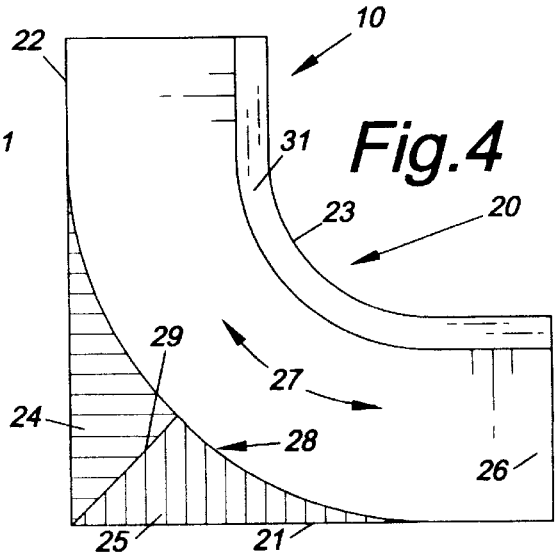
FIG. 4 is a top plan view of the interior corner segment.
Figure 5:
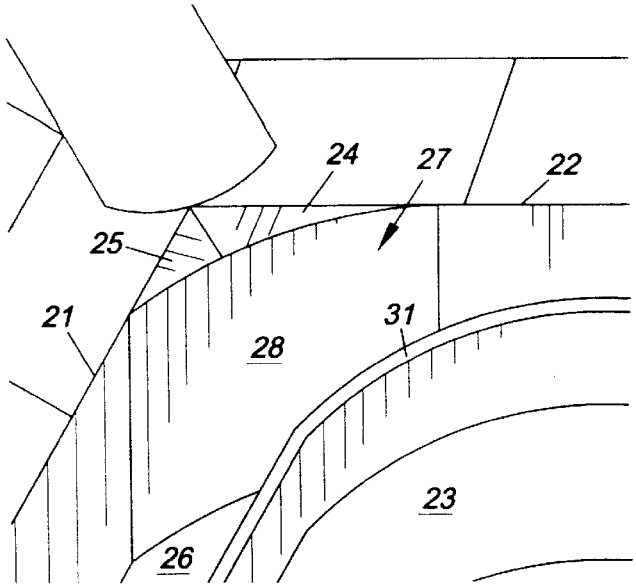
FIG. 5 is an isolated perspective view showing the curvature of the interior corner segment.

As shown in FIG. 3, the drain inserts 24, 25 and 44, 45 on the corner segment 20 have a curved outer surface that defines a smooth curved wall surface 28, 48. The interior corner segment drain inserts 24 and 25 have an elongated common edge 29 and the exterior corner segment drain inserts 44, 45 are tangentially joined together by the juncture 30 of the perpendicularly aligned walls 41, 42.

In addition, the upper portion of all of the drain inserts 24, 25, 44, 45 are sloped downwardly to direct rain water into the respective curved gutter channels 27, 47 and the interior drain inserts 24, 25 are also sloped towards one another to direct rain water towards the apex of the curved wall 28.

Figure 6:
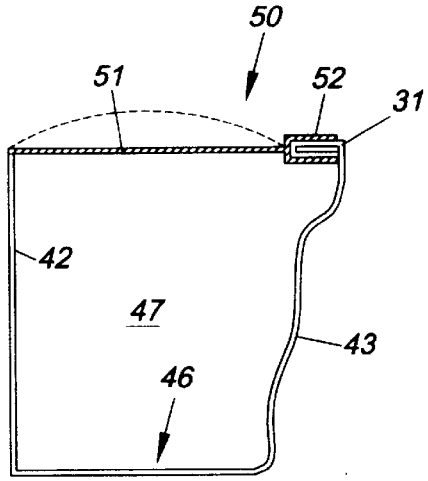
FIG. 6 is a cross sectional view taken through line 6-6 showing the debris screen member in place.
Figure 7:
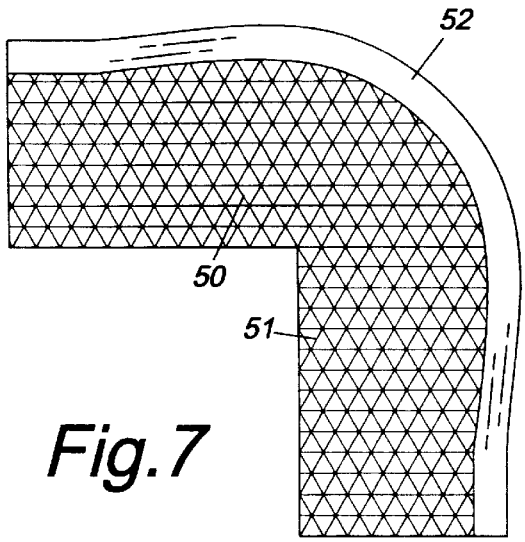
FIG. 7 is a top plan view of the exterior corner segment provided with a debris screen.
Figure 8:
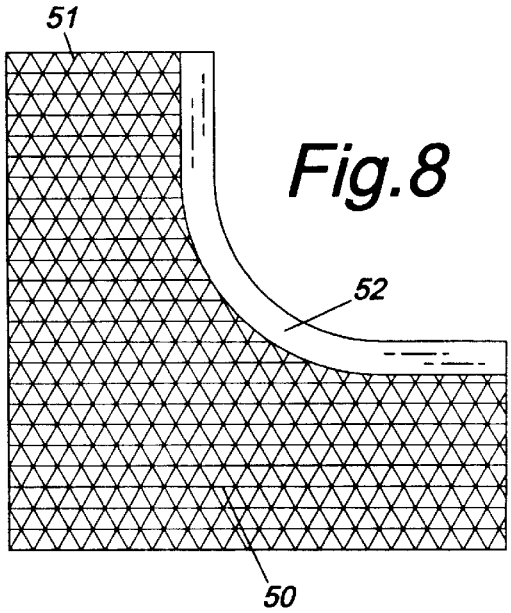
FIG. 8 is a top plan view of the interior corner segment provided with a debris screen.

Turning now to FIGS. 6 through 8, it can be seen that this invention also contemplates the inclusion of an optional clip on cover screen arrangement designated generally as 50. A contoured section of screen netting 51 has an outer edge provided with a generally U-shaped curved channel element 52 that releasably engages the inwardly directed curved lip 31 on the top of both the interior 20 and exterior curved walls 23, 43 respectively and wherein the inner edge of the screen netting will rest on the top of the perpendicularly aligned walls 22, 23 and 42, 43, respectively.

At this juncture, it should be noted that while the specification calls for a pair of contoured drain inserts, particulary in the case of the interior corner segment 20, the pair of drain inserts 24, 25 could be formed integrally with one another as a single piece or component.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A corner segment construction for rain gutters wherein the construction comprises:

a pair of perpendicularly aligned inner walls;

a generally curved outer wall;

a floor panel connecting said walls together; and a pair of contoured interior drain inserts disposed adjacent to one another at the juncture of said perpendicularly aligned walls to define a generally curved gutter channel.

2. The construction as in claim 1 wherein said contoured drain inserts have an outer surface that defines a smooth curved wall.

3. The construction as in claim 2 wherein said smooth curved wall is disposed generally parallel to said curved outer wall.

4. The construction as in claim 3 wherein said contoured drain inserts have an upper surface that is sloped downwardly in the direction of said curved gutter channel.

5. The construction as in claim 4 wherein said contoured drain inserts are disposed adjacent to one another.

6. The construction as in claim 5 wherein said contoured drain inserts have a curved outer surface that is disposed in a tangential fashion with the juncture of said perpendicularly aligned inner walls.

7. The construction as in claim 5 wherein said contoured drain inserts share an elongated common edge.

8. The construction as in claim 7 wherein the top portion of said contoured drain inserts are sloped towards one another in the direction of said elongated common edge.

9. The construction as in claim 5 wherein the top of the curved outer wall is provided with an inwardly directed lip.

10. The construction as in claim 9 further including:

a clip on cover screen arrangement including a contoured section of screen netting having inboard edges dimensioned to rest on said perpendicularly aligned walls and an outboard edge provided with means for releasably engaging said inwardly directed lip of the curved outer wall.

* * * * *